United States Patent [19]

Greenwell

[11] Patent Number: 4,601,691

[45] Date of Patent: Jul. 22, 1986

[54] CARTON FEEDER

[75] Inventor: Joseph D. Greenwell, Florence, Ky.

[73] Assignee: R. A. Jones & Co. Inc., Covington, Ky.

[21] Appl. No.: 672,618

[22] Filed: Nov. 19, 1984

[51] Int. Cl.[4] ..... B31B 1/80

[52] U.S. Cl. ..... 493/313; 493/315

[58] Field of Search ..... 493/123, 124, 310, 313, 493/315, 316, 317, 318

[56] References Cited

U.S. PATENT DOCUMENTS

| | | | |
|---|---|---|---|
| 2,881,682 | 4/1959 | Engelson et al. | 493/316 |
| 2,936,681 | 5/1960 | Earp | 493/310 |
| 3,580,143 | 5/1971 | McIntyre | 493/313 |
| 4,109,444 | 8/1978 | Lee | 493/316 |
| 4,178,839 | 12/1979 | Hughes | 493/313 |

*Primary Examiner*—Francis S. Husar
*Assistant Examiner*—Robert Showalter
*Attorney, Agent, or Firm*—Wood, Herron & Evans

[57] ABSTRACT

In a cartoning machine, apparatus for erecting a carton. The apparatus includes a channel-shaped element having spaced parallel walls and suction cups between the walls of the channel-shaped element. The channel-shaped element engages a carton in a magazine. The suction cups draw the carton into the area between the walls of the channel-shaped element and in so doing cause the carton to open.

5 Claims, 7 Drawing Figures

CARTON FEEDER

This invention relates to a carton feeder which picks flat folded cartons from a magazine, opens and erects the cartons, and deposits the cartons between transport lugs on a transport conveyor. The invention is an improvement in the apparatus of the Hughes U.S. Pat. No. 4,178,839.

The cartoner to which the present invention is applicable is constructed and operates generally as follows: the cartoner has a magazine in which flat folded cartons are placed. A feeder mechanism is provided to remove cartons one at a time from the magazine and to deposit them between leading and trailing transport lugs on a transport conveyor. When deposited between the transport lugs, the cartons are fully erected to a tubular form which is rectangular in cross section. Moving parallel to the transport conveyor is a product conveyor having product buckets aligned with the cartons in the transport lugs. Product, carried in the product buckets, is thrust by a barrel loader into the erected cartons carried in the transport lugs. Downstream, the cartoner provides mechanism for closing the flaps on the cartons with the product contained within.

The carton feeder can be the key to the speed of operation of the entire cartoner. High speed operation is generally desirable in order to minimize the unit cost of packaging the product.

The faster opening which accompanies fast, higher speeds increases the difficulty of opening. The cartons to be opened have four walls which are creased and flat folded, the cartons being formed of relatively stiff paperboard. The paperboard has "fight" which resists opening. When a carton is opened rapidly, a vacuum is created between the walls which lie against one another thereby causing the walls to tend to stay together. When an attempt is made to pull down on a lower wall by vacuum cups, for example, there is a tendency for the two walls to move together causing an "elbowing" rather than opening.

The Hughes invention of U.S. Pat. No. 4,178,839 provides a solution to the problem. The Hughes invention includes a channel-shaped element, a bellows cup between the walls of the channel-shaped element, and means for moving the channel-shaped element between a magazine and the transport conveyor. The edges of the channel-shaped element engage the walls of the carton inboard of the edges. Simultaneously with engagement, the bellows cup causes the engaged wall to pull down slightly into the space between the walls thereby causing a slight bowing of that engaged wall. The opposite wall bows in the opposite direction thereby creating a partial opening of the carton and eliminates the vacuum effect when forces are applied to fully erect the carton. Such forces for fully opening the carton may be imparted by passing the channel-shaped element by another surface which engages the carton walls and cams them to an erect attitude.

Some cartons which are long and thin may not respond well to the Hughes structure. For example, toothbrush cartons, and particularly those having a cut-out portion which exposes the toothbrush bristles to view, are not easily opened by using the Hughes channel-shaped element. The walls are not uniformly rigid and the shape of the carton tends to become somewhat distorted by the time the carton is filled and closed.

It has been an objective of the present invention to improve the erecting of certain cartons, particularly long, thin cartons.

This objective of the invention is attained by modifying the relationship of the Hughes channel-shaped element to the flat folded carton so that the walls of the channel are spaced apart by a distance slightly greater than the length of the carton. The "length" of a carton is, in cartoning parlance, the dimension of the carton in the machine direction when the carton is placed in the transport lugs. The suction cups mounted between the walls of the channel-shaped element pull the carton within the walls and thereby provide support against distortion all along the length of the carton. Between those walls, the carton can be substantially completely erected particularly if the carton is subjected to overbreak by carrying it past a break bar.

The objective of the invention is further obtained by providing a ledge or shoulder along one of the walls of the channel-shaped element to engage an edge fold of the carton thereby limiting the extent of entry of the carton into the channel. Further, the channel wall opposite that containing the ledge is made slightly higher to provide more complete erecting of the carton before it is carried past a break bar, thereby providing more surface area to be engaged by the break bar as it passes over the break bar.

The several objectives and features of the invention will become more readily apparent from the following detailed description taken in conjunction with the accompanying drawings in which.

Figure 1:
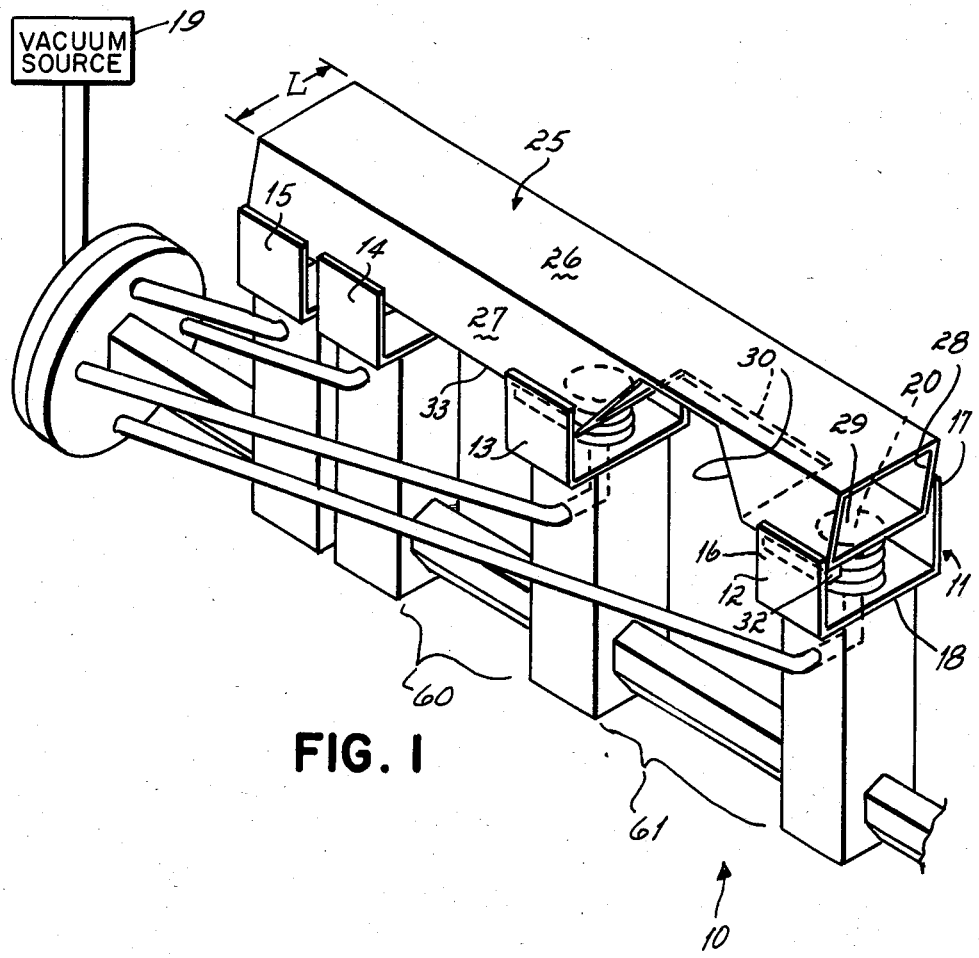
FIG. 1 is a diagrammatic perspective view showing the device for engaging and opening a carton.
Figure 5A:
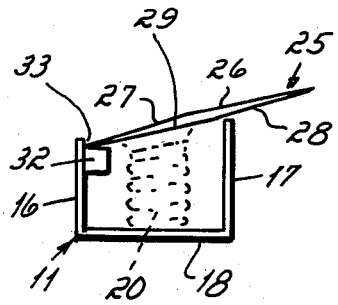
Figure 5B:
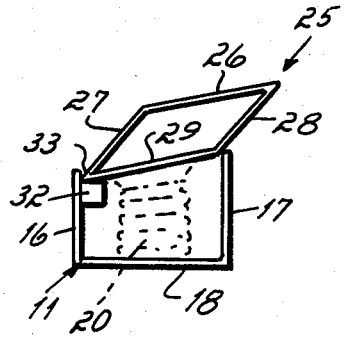
Figure 5C:
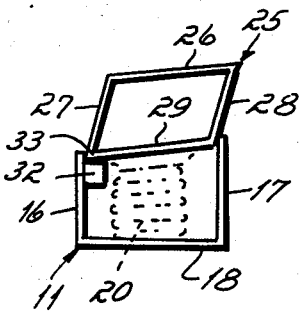

FIGS. 5*a*, 5*b* and 5*c* are diagrammatic side-elevational views illustrating the stages of engaging and opening a carton with a device of FIG. 1.

Referring to FIG. 1, the carton opening device of the present invention is shown at 10. It includes a channel-shaped element 11 which, in the illustrated embodiment, is transversely divided into segments 12, 13, 14, and 15. The number and spacing of the segments 12–15 is dependent upon two principal factors. First, spaces must be left in the channel-shaped element 11 in order to cooperate with the transport lugs of a transport conveyor as will be discussed below. Second, it is desirable to grip the carton at as many points along its length as possible in order to hold it securely and to prevent any twisting during the opening operation and the deposit of the carton onto the transport conveyor.

Each channel-shaped segment has a leading leg 16 and a trailing leg 17, the legs 16 and 17 being integral with a bottom wall 18. The bottom wall 18 supports a bellows-shaped suction cup 20 which is connected to a source of vacuum 19. A control system (not shown) is provided to apply vacuum to each bellows cup at the instant of engagement of the cup with a carton in the magazine and to release the vacuum at the instant of deposit of the carton onto the transport conveyor.

The carton indicated at 25 has a bottom wall 26, side walls 27 and 28, and a top wall 29. The carton also has conventional end flaps (not shown) which are closed in the usual manner after the carton has been filled. The length dimension of the carton, that is, the dimension of the carton in the direction of movement of the transport conveyor, is indicated at L.

The legs 16 and 17 of the channel-shaped member are parallel to each other and are spaced apart by a distance slightly greater than L so that when the carton is pulled by the suction cups 20 into the space between the legs 16 and 17, the legs will tend to cam the carton into an open condition.

The carton 25 has an opening 30 in a side wall 27 and in the top wall 29. That opening, coupled with the natural fight of the paperboard from which the carton is made, introduces a tendency for the carton to skew when it is erected. That tendency is minimized by providing a secure grip upon the carton and by overbreaking the carton, as will be discussed below.

The leg 16 of each channel-shaped element has a ledge or shoulder 32 which is engaged by the folded edge 33 of the carton and prevents the carton from being pulled by the bellows cups to too great an extent toward the bottom wall 18 of the channel-shaped elements. The opposed leg 17 is slightly longer than the leg 16 thereby providing a higher carton supporting surface against which the carton is cammed in order to open it to a greater extent than would be otherwise possible. The greater opening of the carton exposes more surface area for overbreaking, as will be discussed below.

The device of FIG. 1 is mounted in an apparatus which moves it from a magazine 40 containing a stack of cartons 25 to a transport conveyor 41. The apparatus which moves the channel-shaped device 10 may take any kinematic form. One example of such apparatus is found in the Greenwell application Ser. No. 395,228, filed July 6, 1982 now U.S. Pat. No. 4,518,301.

The apparatus includes a wheel 45 which is rotatable in the direction of the arrow 46. The wheel contains a plurality of channel-shaped elements 10 each of which is rotatable with respect to the wheel in the direction of the arrow 47. A cam mechanism or planetary gearing may be employed to cause the channel-shaped elements 10 to rotate with respect to the wheel 45 as the wheel rotates.

Figure 2:
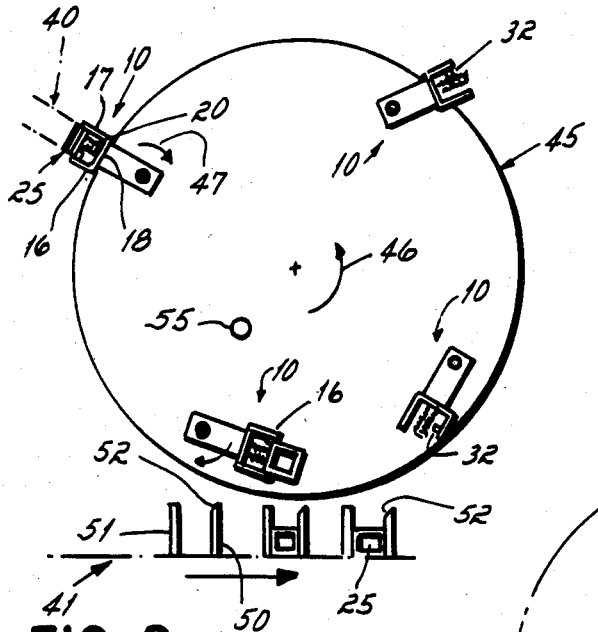
FIG. 2 is a diagrammatic side-elevational view showing one type of apparatus for employing the device of FIG. 1.
Figure 4:
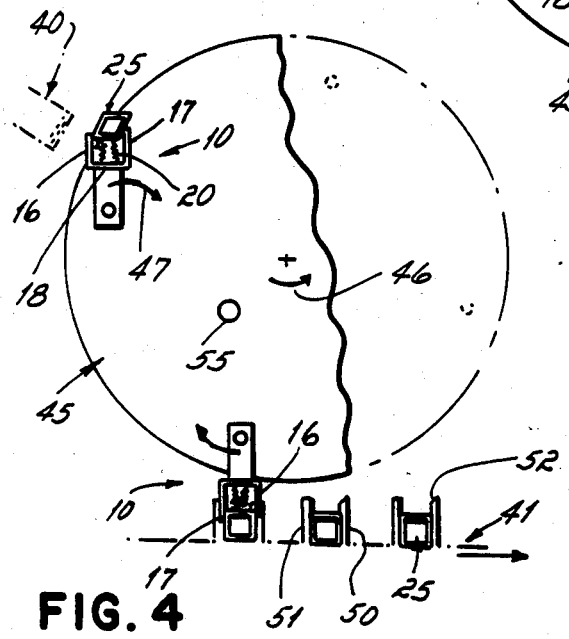

The apparatus which moves the channel-shaped elements presents two primary positions for the channel-shaped elements; namely, the position depicted in FIG. 2 wherein the channel-shaped element is in engagement with the magazine to pick up a carton, and the position depicted in FIG. 4 wherein the channel-shaped element is depositing a carton onto the transport conveyor 41.

The transport conveyor 41 has leading lugs 50 and trailing lugs 51. The lugs preferably have inclined surfaces 52 at their upper ends in order to facilitate the introduction of the carton to a position between them as shown in the drawings.

Figure 3:
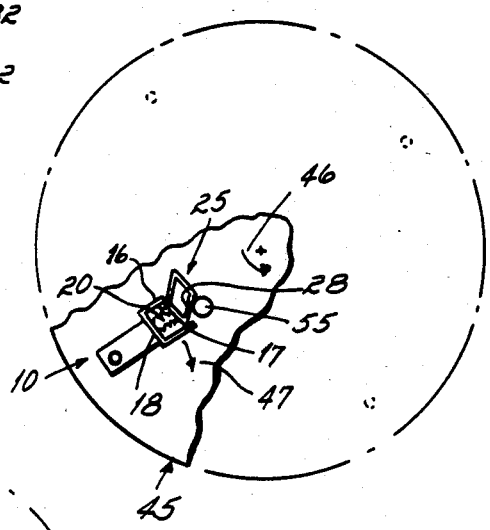
FIGS. 3 and 4 are views similar to that of FIG. 2 illustrating the sequence of operations.

A stationary break bar 55 is mounted adjacent the wheel 45. As best seen in FIG. 3, the break bar is located in a position adjacent the path of the channel-shaped element 10 as it is carried by the wheel 45 and orbits with respect to the wheel 45 so that the carton 25 is wiped across the break bar to flex the side walls with respect to their crease lines on the upper and lower walls, respectively, and thus take the fight out of the creases before the cartons are deposited onto the transport conveyor 41.

In the operation of the invention, the channel-shaped element 10 is carried into a position of engagement with the cartons 25 in the magazine 40 as depicted in FIG. 2. At the time of engagement, a vacuum is applied to the bellows-shaped suction cup 20. The combined action of the four cups pulls the carton out of the magazine toward the channel-shaped elements. The position of the elements at the time of engagement is depicted in FIG. 5*a*. FIG. 5*b* shows the creased edge 33 of the flat folded carton engaging the ledge or shoulder 32 on each leg 16 of the channel-shaped element. This engagement with the ledge prevents the carton from sliding to too great an extent into the space between the legs 16 and 17 of the channel-shaped element. The ledge 32 also provides a fulcrum about which the top wall 29 swings to begin the opening of the carton. The side wall 28 of the carton is engaged by the upper edge of leg 17 and is cammed to rotate with respect to the wall 29, thereby forcing the carton to an opened condition. That situation is shown by reference to FIGS. 5*b* and 5*c*.

When the carton is fully drawn into the space between the two legs 16 and 17, it lacks but a few degrees of being fully opened as depicted in FIG. 5*c*. In this condition, there is still considerable resistance to fully opening that emanates from the four creases which join the four walls.

The channel-shaped element 10 therefore moves past the break bar 55 as shown in FIG. 3. The height of the wall 17 has forced the carton close to a fully opened condition so that a substantial surface area of the wall 28 is presented to the break bar, thereby insuring good contact.

After passing the break bar 55, the carton will be substantially fully open. Continued movement of the wheel 45 will bring the channel-shaped element 10 into a position adjacent a set of leading and trailing lugs 50 and 51 on the transport conveyor. The action at this point is depicted in the Greenwell application Ser. No. 395,288, filed July 6, 1982. When the carton is in that condition, as depicted in FIG. 4, the vacuum is released and the carton remains between the transport lugs in a condition for filling and closing.

To provide for the movement of the channel-shaped element past the transport lugs 50 and 51, the channel-shaped element is segmented as shown in FIG. 1 in order to provide spaces 60 and 61 which are in the path of side-by-side leading and trailing lugs 50 and 51.

Having described my invention, I claim:

1. In cartoning apparatus having a magazine for flat folded cartons, which when erected will have a length L, and a transport conveyor located adjacent said magazine and having leading and trailing transport lugs for conveying erected cartons, a carton feeder located adjacent said magazine and transport conveyor for engaging flat folded cartons in said magazine, erecting said cartons and placing said cartons between said transport lugs, said carton feeder comprising:

a channel-shaped element, having parallel legs, said legs being spaced apart approximately a distance L, at least one bellows suction cup mounted on said channel-shaped element and located between said legs, means connected to said suction cup for applying a vacuum to said suction cup, and means connected to said channel-shaped element for moving said channel-shaped element and suction cup between said magazine and said transport conveyor, said suction cup engaging a top wall of said carton and drawing said top wall and a portion of the side walls between the legs of said channel-shaped member to substantially erect the carton and deposit it between leading and trailing lugs of said transport conveyor.

2. A carton feeder as in claim 1 further comprising:

a shoulder mounted on one leg of said channel-shaped member adjacent the edge fold of the carton, said shoulder being engaged by said edge fold to prevent said carton from sliding too far within said channel-shaped element.

3. A carton feeder as in claim 2 in which the leg opposite the leg having said shoulder projects beyond said leg having said shoulder to increase the extent of opening of the carton when said suction cups pull said carton into said channel-shaped element.

4. A carton feeder as in claim 1 further comprising:

a break bar mounted between said magazine and said transport conveyor adjacent the path of said channel-shaped element, said channel-shaped element carrying a carton past said bar to wipe said carton across said bar to overbreak it prior to depositing the carton between said transport lugs.

5. A carton feeder as in claim 1 in which said channel-shaped element is formed of:

a plurality of transversely-spaced channel-shaped segments having parallel legs lying in two parallel planes, and a plurality of suction cups disposed between said two planes.

* * * * *